United States Patent [19]

Morath

[11] 4,065,949

[45] Jan. 3, 1978

[54] STRAIGHTENING APPARATUS

[75] Inventor: Günther Morath, St. Ingbert, Germany

[73] Assignee: Moeller & Neumann GmbH, St. Ingbert, Saar, Germany

[21] Appl. No.: 751,358

[22] Filed: Dec. 16, 1976

[30] Foreign Application Priority Data

Dec. 18, 1975 Germany ..... 2557061

[51] Int. Cl.[2] ..... B21D 1/02

[52] U.S. Cl. ..... 72/164

[58] Field of Search ..... 72/164, 160, 165, 162, 72/181

[56] References Cited

U.S. PATENT DOCUMENTS

| | | | |
|---|---|---|---|
| 3,457,754 | 7/1969 | Hagemann et al. | 72/164 |
| 3,621,693 | 11/1971 | Adams | 72/164 |

FOREIGN PATENT DOCUMENTS

| | | | |
|---|---|---|---|
| 2,038,012 | 2/1972 | Germany | 72/164 |

*Primary Examiner*—Milton S. Mehr

*Attorney, Agent, or Firm*—John J. Dennemeyer

[57] ABSTRACT

Straightening apparatus as a frame with upper and lower horizontal supports extending between uprights. Straightening roll units are mounted in cooperative relationship on these supports and are capable of sliding movement therealong. The upper straightening rolls are vertically fixed while the lower rolls are vertically adjustable to alter the rolling gap. Tension members interconnect the upper roll units and the lower support.

4 Claims, 3 Drawing Figures

Figure 3:
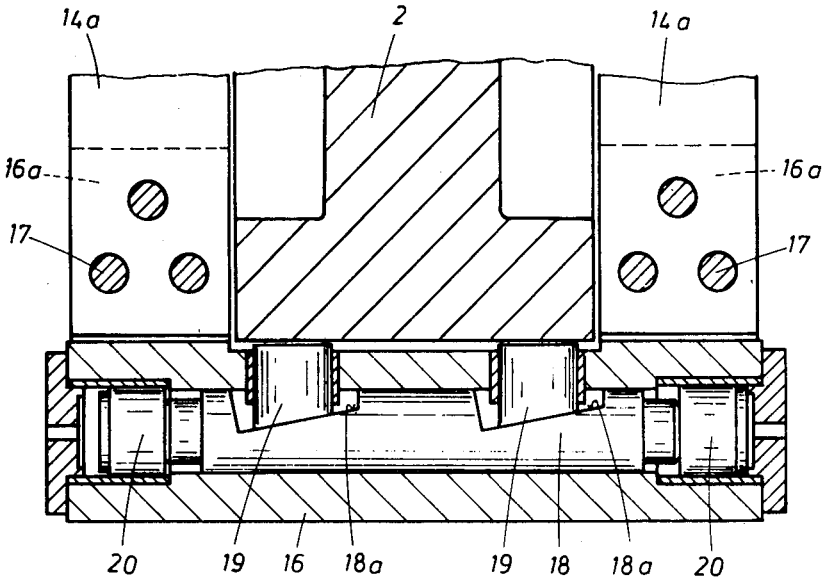

Fig. 1
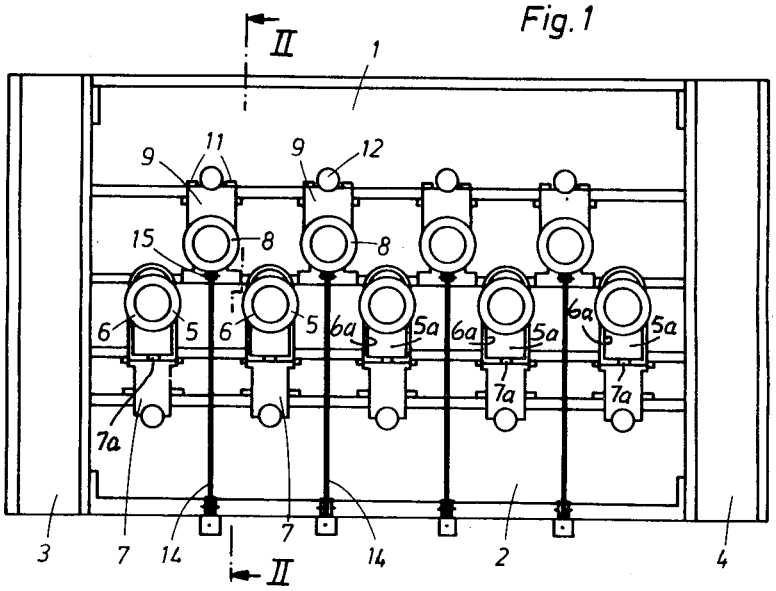
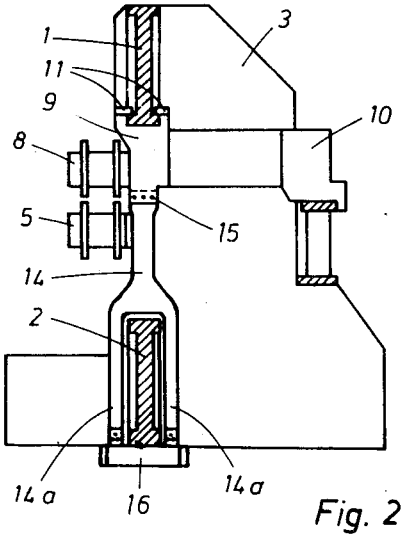
Fig. 2

STRAIGHTENING APPARATUS

The invention relates to straightening rolls, in particular heavy straightening rolls with a variable spacing between the straightening rolls, in which the rack-like machine frame formed from two horizontal supports and two side pieces is strengthened by tension members, which connect the mountings of straightening spindles to one of the supports subject to bending stress in a manner which allows an adjustment of straightening spindles in the longitudinal direction of the machine (German Offenlegungsschrift 1,552,929, which corresponds to U.S. Pat. No. 3,457,754).

In heavy straightening rolls according to the prior art, the tension members extend between the straightening spindle housings of the lower straightening spindles and the upper support of the machine frame. These straightening spindle housings representing the mountings of the straightening spindles are necessary for the lower straightening spindles, since the latter must be vertically adjustable by way of their bearing housings or mounting members in corresponding openings in the straightening spindle housing, since for altering the spacing between the straightening rolls, the upper straightening rolls with their straightening roll spindles are adjustable in the longitudinal direction of this machine, but are fixed in the vertical position. Thus, in known straightening rolls, the straightening spindle housing of the lower straightening spindles is part of the tension members. The straightening spindle housings are thus subject to stresses similar to those which occur in a roll housing due to the rolling force, since the straightening spindle housings have a frame-like construction with upper and lower cross bars and side plates. Thus, bending stresses also occur in the known tension members, so that they are less rigid than a continuous member in the form of a tie-rod would be. The possibility of making the straightening spindle housing more rigid due to an accumulation of material, is curtailed due to the change of the spacing between the straightening rolls in the horizontal plane, since under certain circumstances, the straightening rollers must be able to be adjusted to the narrowest possible horizontal spacing according to the section to be straightened.

It is therefore the object of the invention to increase the strengthening effect achieved by the tension members extending between the upper and lower supports of the rack-like machine frame, especially since in heavy straightening rolls with a considerable number of straightening rolls, the bending of the upper and lower supports under load is considerable. The solution of this object consists in that the tension members engage the bearing housings adjacent the straightening rolls of the upper straightening roll spindles which are not vertically adjustable.

It is thus achieved that the tension members may be constructed as tie-rods with a largely uniform cross section, which can be made large enough without jeopardising the possibility of adjusting narrow horizontal spaces between the straightening rolls. Strengthening of the upper and lower supports for the machine frame can be improved in a particularly progressive manner to such an extent that bending of the supports under load in the case of vertical adjustment of the lower straightening rolls hardly needs to be taken into consideration, with the result that when a section to be straightened is introduced, virtually no oscillations occur and the machine operates in an extraordinarily quiet manner.

The introduction of the sections to be straightened without oscillations is further promoted due to the fact that in a further development of the invention, the tension members are each provided at their lower ends with a tensioning device. By means of these tensioning devices, it is possible to take up any play between the tension members which are adjustable in the longitudinal direction of the machine and the upper and lower horizontal supports, after the tension members have been set at the desired horizontal roll spacing.

Details of the construction of the lower ends of the tie-rods in conjunction with the tensioning device according to the invention are the subject of claims 3 and 4.

One embodiment of heavy straightening rolls according to the invention is illustrated in the drawings and in particular FIG. 1 is a side view in the direction of the roll spindles, FIG. 2 is a vertical section on line II—II of FIG. 1 and FIG. 3 is an enlarged partial section according to FIG. 2 through the lower end of the lower support and of a tension member with tensioning device.

The rack-like machine frame of the straightening machine consists of the upper and lower supports 1 and 2 which are resistant to bending and of the side members 3 and 4. The upper and lower supports 1, 2 may also be constructed in several parts. The straightening machine has five lower straightening rolls 5, mounted similarly to the lower straightening rolls of U.S. Pat. No. 3,457,754. Roll spindles **5*a* carrying the straightening rolls 5 are mounted in vertically adjustable mounting bearing members 6, which are guided for vertical movement in openings 6*a* provided in the straightening spindle housings 7. The straightening spindle housings 7 also receive the adjusting gear for altering the vertical spacing of the rolls, which includes vertically adjustable spindles 7*a* on which the bearing members 6 are mounted, and are mounted to be horizontally adjustable in the longitudinal direction on the lower support 2. The straightening pressure absorbed by the latter passes into the lower support 2**.

The machine has four upper straightening rolls 8, whose spindles are mounted in bearing housings 9 and 10 (FIG. 2), which are not vertically adjustable, but are supported by the upper support 1 so that they can be horizontally adjusted in the longitudinal direction thereon. The bearing housing 9 adjacent the rolls is connected by way of two pairs of strips 11 and a roller 12 (FIG. 1) to the lower flange of the upper support 1, on which the bearing housing 9 bears under straightening pressure.

According to the invention, it is the bearing housings 9 adjacent the rollers, of the vertically non-adjustable upper straightening roll spindles, which are connected directly by way of tension members 14 to the lower support 2. In the embodiment, three locating pins 15 serve to connect the tension member 14 to the bearing housing 9, which pins penetrate two vertical strips of a bearing housing as well as the upper end of a tension member 14 inserted between the strips.

The sole task of the tension members 14 is to take up tension between the upper bearing housings 9 and the lower support 2 and they may therefore be constructed in a very rigid manner with very narrow overall width in the longitudinal direction of the machine. At their lower ends, the tension members 14 are constructed as a fork 14*a* overlapping the lower support 2 of the machine frame, which fork is closed-off by a cross bar 16, which receives a tensioning device according to FIG. 3. FIG. 3 shows the lower end of the lower support 2 with the lower ends of the fork 14*a* of a tension member 14. Pairs of upright side plates 16*a* of the lower cross bar 16 are connected to these lower ends of the fork 14*a* by three locating pins 17.

The cross bar 16 closing-off the fork of a tension member 14 is simultaneously the cylinder of a hydraulic tensioning device for removing the play in a tension member with respect to the two horizontal supports 1 and 2. The tensioning device consists of a straight wedge mechanism with a hydraulically reciprocating piston 18, which is provided with two wedge surfaces 18*a*. Associated with each wedge surface 18*a* is a thrust bolt 19 able to be placed against the lower surface of the lower support 2, which are guided in the cross bar 16 and simultaneously ensure the rotary position of the tensioning piston 18. Guided on both sides of the tensioning piston 18 are loose pressure pistons 20, which can be supplied alternately with a hydraulic pressure medium, in order to move the tensioning piston 18 to and fro. When travelling towards the left, the thrust bolts 19 are moved upwards, whereby the respective tension member 14 is pre-tensioned and any play is eliminated both in the region of the upper mounting on the pairs of strips 11 as well as at the lower end of the tension member, so that straightening pressure occurring at the upper straightening rolls 8 is taken up by the tension members to a considerable extent and the load is removed from the two horizontal supports 1, 2. The latter may thus be constructed in a correspondingly lighter manner.

What is claimed is:

1. Straightening apparatus comprising: a frame defined by two uprights and upper and lower horizontal supports extending between said uprights, a plurality of vertically fixed upper straightening roll units slidably mounted on said upper horizontal support and including vertically non-adjustable upper straightening spindle housings, a cooperative plurality of lower straightening roll units slidably mounted on said lower horizontal support and including vertically adjustable lower straightening spindle housings, a plurality of tension members interconnecting the upper straightening roll units with said lower horizontal support, the upper end of each tension member being connected with its associated upper roll unit and being slidable therewith, and the lower end thereof being slidably connected with said lower horizontal support, and a tensioning device provided for each tension member arranged so that when loosened said tension members can be slid longitudinally of said upper and lower horizontal supports, and so that when tightened said upper and said lower horizontal supports are substantially rigidly interconnected thereby.

2. Apparatus as claimed in claim 1, wherein a tensioning device is provided at the lower end of each tension member.

3. Apparatus as claimed in claim 2, wherein the lower end of each tension member is in the form of a fork in which the lower support is received, an a cross-bar incorporating said tensioning device closes off the fork beneath the lower support.

4. Apparatus as claimed in claim 3, wherein the tensioning device consists of a straight wedge mechanism with a hydraulically reciprocating tensioning piston provided with at least one wedge surface, a thrust bolt which can be placed against the lower surface of the lower support being associated with each wedge surface.

* * * * *